US008516768B2

(12) United States Patent
Johnson, III

(10) Patent No.: US 8,516,768 B2
(45) Date of Patent: Aug. 27, 2013

(54) MASONRY WALL ANCHOR AND SEISMIC WALL ANCHORING SYSTEM

(75) Inventor: Ralph O. Johnson, III, Charlotte, NC (US)

(73) Assignee: Masonry Reinforcing Corporation of America, Charlotte, NC (US)

( * ) Notice: Subject to any disclaimer, the term of this patent is extended or adjusted under 35 U.S.C. 154(b) by 122 days.

(21) Appl. No.: 13/105,415

(22) Filed: May 11, 2011

(65) Prior Publication Data

US 2012/0285111 A1 Nov. 15, 2012

(51) Int. Cl.

| | |
|---|---|
| ***E04B 1/16*** | (2006.01) |
| ***E04B 1/02*** | (2006.01) |
| ***E04B 1/38*** | (2006.01) |
| ***E04C 3/30*** | (2006.01) |
| ***E04C 5/00*** | (2006.01) |

(52) U.S. Cl.
USPC ..... 52/713; 52/379; 52/383; 52/562

(58) Field of Classification Search
USPC ..... 52/378, 379, 380, 383, 561, 562, 52/698, 712, 713, 710, 513, 426, 565
See application file for complete search history.

(56) References Cited

U.S. PATENT DOCUMENTS

| | | | | |
|---|---|---|---|---|
| 1,729,935 | A | 3/1928 | Froehlich | |
| 1,934,760 | A * | 11/1933 | Awbrey | 52/710 |
| 2,596,028 | A | 5/1952 | James | |
| 3,341,998 | A * | 9/1967 | Lucas | 52/379 |
| 3,559,358 | A | 2/1971 | Lohse et al. | |
| 4,206,577 | A * | 6/1980 | Moriez et al. | 52/405.2 |
| 4,598,518 | A * | 7/1986 | Hohmann | 52/410 |
| 4,622,796 | A * | 11/1986 | Aziz et al. | 52/747.12 |
| 4,827,684 | A * | 5/1989 | Allan | 52/378 |
| 4,875,319 | A * | 10/1989 | Hohmann | 52/383 |
| 4,955,172 | A * | 9/1990 | Pierson | 52/710 |
| 5,035,099 | A * | 7/1991 | Lapish | 52/713 |
| 5,207,043 | A * | 5/1993 | McGee et al. | 52/379 |
| 5,392,581 | A * | 2/1995 | Hatzinikolas et al. | 52/712 |
| 5,816,008 | A * | 10/1998 | Hohmann | 52/565 |
| 6,279,283 | B1 * | 8/2001 | Hohmann et al. | 52/379 |
| 7,225,590 | B1 * | 6/2007 | diGirolamo et al. | 52/379 |
| 7,325,366 | B1 * | 2/2008 | Hohmann et al. | 52/513 |
| 7,469,511 | B2 * | 12/2008 | Wobber | 52/474 |
| 7,845,137 | B2 * | 12/2010 | Hohmann, Jr. | 52/714 |
| 8,096,090 | B1 * | 1/2012 | Hohmann et al. | 52/513 |
| 8,122,663 | B1 * | 2/2012 | Hohmann et al. | 52/379 |
| 8,291,672 | B2 * | 10/2012 | Hohmann et al. | 52/698 |
| 2007/0062138 | A1 * | 3/2007 | Wobber | 52/379 |
| 2008/0092472 | A1 * | 4/2008 | Doerr et al. | 52/379 |
| 2008/0115439 | A1 * | 5/2008 | Tamlyn | 52/379 |
| 2011/0146195 | A1 * | 6/2011 | Hohmann, Jr. | 52/713 |

* cited by examiner

*Primary Examiner* — Ryan Kwiecinski
(74) *Attorney, Agent, or Firm* — Shumaker, Loop & Kendrick, LLP

(57) ABSTRACT

A two-piece masonry anchor including a plate having opposing faces, an attachment feature extending from one of the faces, and a leg extending from the other of the faces having an insulation thickness guide and an elongate slot transverse to the extension direction of the leg, and an anchor adapted to attach to the leg of the plate and having first and second portions arranged to define a right angle therebetween. A seismic wall anchoring system including a plurality of masonry anchors interconnected by a rod.

11 Claims, 3 Drawing Sheets

MASONRY WALL ANCHOR AND SEISMIC WALL ANCHORING SYSTEM

TECHNICAL FIELD AND BACKGROUND

The present invention relates generally to the field of wall anchors for tying together spaced-apart walls, and more particularly, to a wall anchor and seismic wall anchoring system adapted for use in insulation applications for tying together spaced-apart walls in a manner that accommodates vertical movement between the walls without disconnection of the anchor parts, as well a wall anchor including an insulation thickness guide.

Masonry wall construction requires tying together spaced-apart walls to anchor an outer brick veneer wall to an inner structural wall. Inner walls may be constructed from concrete block or poured concrete. Insulated masonry walls additionally include an insulating layer disposed between the inner and outer walls, such as spray foam applied to the exterior of the inner wall, foam board, or like material. Masonry walls may include additional layers and coatings such as water-blocking layers.

Masonry walls are commonly anchored using a plurality of masonry anchors positioned spaced apart along the length and height of the wall. Each masonry anchor typically includes a first part that secures to the inner wall between courses or to ladder or truss-type framework, and a second part that secures to the outer wall between courses of brick. The first and second parts attach to anchor the outer wall to the inner wall and prevent lateral movement therebetween. Poured concrete inner wall construction additionally requires guide rails, slots or fasteners on the exterior surface of the inner wall for securing the masonry anchors.

While conventional masonry anchors exist for anchoring an outer veneer wall to an inner poured concrete wall, such anchors do not install easily without requiring special tools or fasteners, do not adequately prevent lateral movement between walls while accommodating seismic events without detachment, and are not suitable for use in insulated masonry wall applications.

BRIEF SUMMARY

Accordingly, in one aspect a masonry wall anchor is provided adapted to accommodate vertical wall movement and substantially prevent lateral wall movement without disconnection of the anchor parts.

In another aspect, a masonry anchor and seismic anchoring system is provided herein suitable for use in geographic areas subject to seismic disturbance.

In another aspect, a masonry anchor is provided herein that imparts improved structural stability to the wall.

In another aspect, a masonry anchor is provided herein adapted for use in insulated masonry wall applications.

In another aspect, a masonry anchor and seismic anchoring system is provided herein for use in any wall make-up requiring spray foam or rigid foam insulation.

In another aspect, a masonry anchor and seismic anchoring system is provided herein that facilitates consistent spray foam thickness, avoids post insulation application punctures and penetrations, avoids residue build-up, avoids anchor pull, and provides full anchor stability and embedment, among other advantages.

These and other aspects and advantages of the invention are achieved by providing in one embodiment a masonry anchor including a plate having opposing faces, an attachment feature extending from one of the faces, and a leg extending from the other of the faces having an insulation thickness guide and an elongate slot therethrough positioned adjacent a free end of the leg and oriented transverse to the extension direction of the leg, and an anchor adapted to attach to the leg including first and second portions arranged to define a right angle therebetween. The anchor is movable in a vertical direction and substantially immovable in a lateral direction with respect to the leg when attached to the leg.

In another embodiment, a masonry wall anchoring system is provided herein including a plurality of masonry anchors and an elongate rod interconnecting masonry anchors of a common row. Each of the masonry anchors includes a plate having opposing faces, an attachment feature extending from one of the faces, and a leg extending from the other of the faces having an insulation thickness guide and an elongate slot positioned adjacent a free end of the leg and oriented transverse to the extension direction of the leg, and an anchor adapted to attach to the leg including first and second portions arranged to define a right angle therebetween.

In another embodiment, a masonry wall anchoring system is provided herein including a first wall including vertically extending slots on a common surface of the wall, a second wall constructed of courses of block, a plurality of masonry anchors adapted to tie the first wall to the second wall, and an elongate rod captured by the anchors of masonry anchors of a common row.

Additional features and advantages of the invention will be set forth in the detailed description which follows, and in part will be readily apparent to those skilled in the art from that description or recognized by practicing the invention as described herein.

BRIEF DESCRIPTION OF THE DRAWINGS

Aspects and advantages of the embodiments are understood when the detailed description is read with reference to the following drawings, in which.

DETAILED DESCRIPTION OF THE EMBODIMENTS

Figure 1:
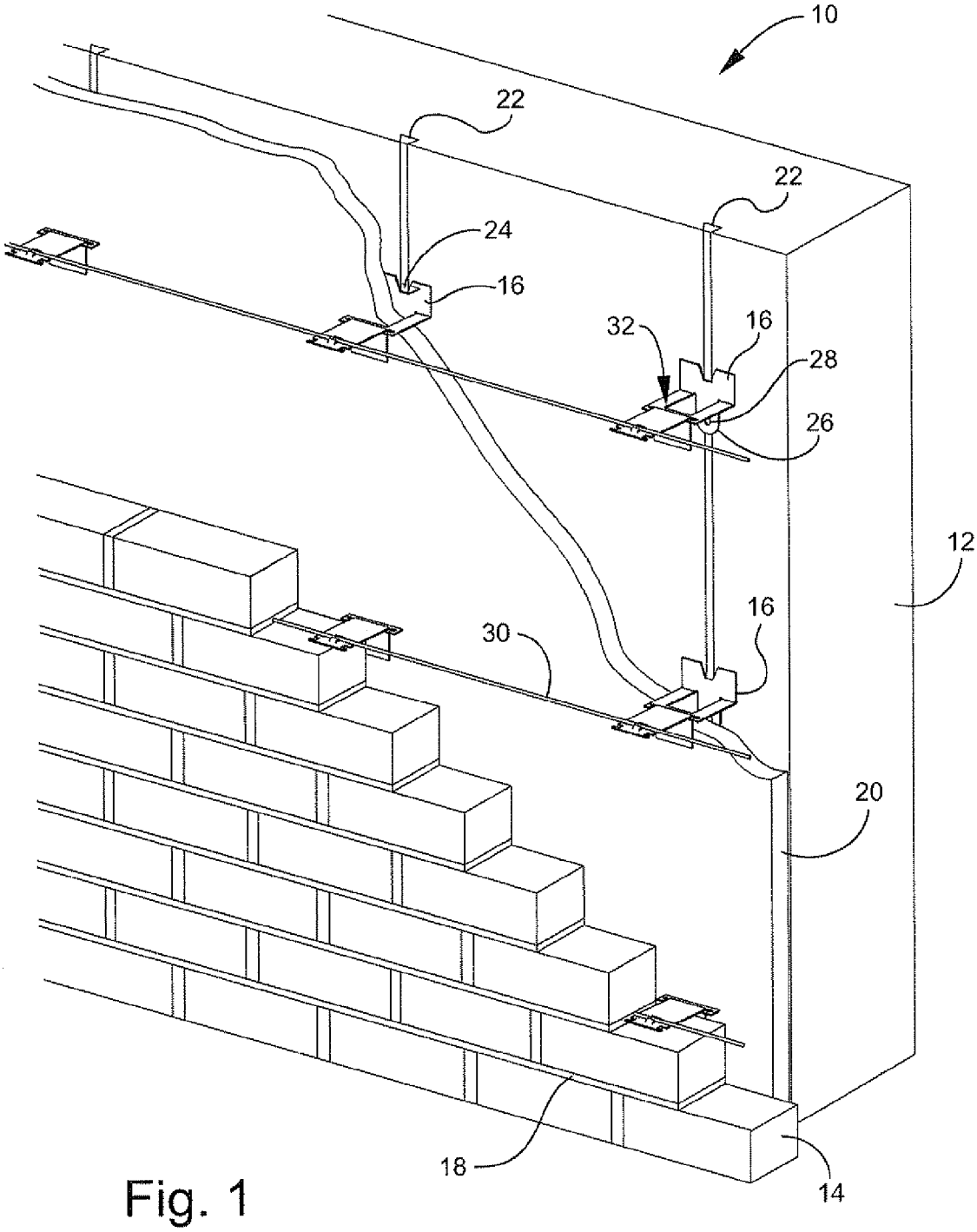
FIG. 1 is a perspective view of a partial masonry wall construction including a plurality of masonry anchors for tying together spaced-apart walls.

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numerals refer to like elements throughout the drawings.

Referring to FIG. 1, a partially constructed masonry wall is shown generally at reference numeral 10. Wall 10 generally includes inner wall 12 tied to outer wall 14 utilizing a plurality of masonry anchors 16 installed at spaced-apart locations along the length and height of wall 10. Inner wall 12 is constructed of poured concrete or like construction lacking.

Outer wall 14 is constructed of overlying courses of brick veneer or like material bonded together with mortar 18. Insulation layer 20 is positioned between inner wall 12 and outer wall 14 and provides insulative properties to wall 10. Although not shown, it is envisioned that wall 10 can include additional layers such as a water blocking bather or sealing layer.

Insulation layer 20 can be spray foam, foam board, or like material, and is preferably spray foam applied to the exterior surface of inner wall 20. Insulation layer 20 encapsulates a portion of one part of each of masonry anchors 12. Insulation layer 20 is applied to a thickness that leaves an attachment portion of the first part of masonry anchor 16 exposed to engage a second part of masonry anchor 16. The length of the slot carrying portion or "leg" of each masonry anchor 16 serves as an insulation thickness guide. In one installation application, a spray foam installer can use the slotted leg of the dovetail plate portion of masonry anchor 16 as a guide for different thicknesses of spray foam. The slotted leg can carry indicia thereon indicating different insulation thicknesses selected based upon application and code. In one example, spray foam is applied to a depth adjacent slot 32.

The exterior surface of inner wall 12 defines a plurality of continuous, vertically-extending slots 22 for receiving an attachment feature of masonry anchor 16 therein. Alternatively, slot-defining guide rails or tracks can be secured to the exterior surface of or embedded within inner wall 12. As shown, slots 22 are spaced-apart and each defines a generally trapezoidal cross-section for receiving a complimentary dovetail 24 attachment feature. Multiple anchors 16 received within a common slot 22 can be inserted from above and slid vertically downward into place or may be inserted at an angle and twisted into position. In one embodiment, masonry anchors 16 can be maintained in place until secured to outer wall 14 or embedded within insulation layer 20 using a conventional fastener received through opening 28 defined through flange 26.

Masonry anchors 16 installed in a common row cooperatively capture a continuos rod 30 for added structural support. The rod-capturing end of each anchor 16 and rod 30 are embedded in mortar 18 of outer wall 14. As described in detail below, each masonry anchor 16 generally includes a first part that attaches to inner wall 12 and a second part that attaches to outer wall 14. The first and second parts can be generally coplanar when installed or offset so long as they remain attached. Masonry anchors 16 tie outer wall 14 to inner wall 12, accommodate some vertical movement between walls, and substantially prevent lateral movement between walls.

Figure 2:
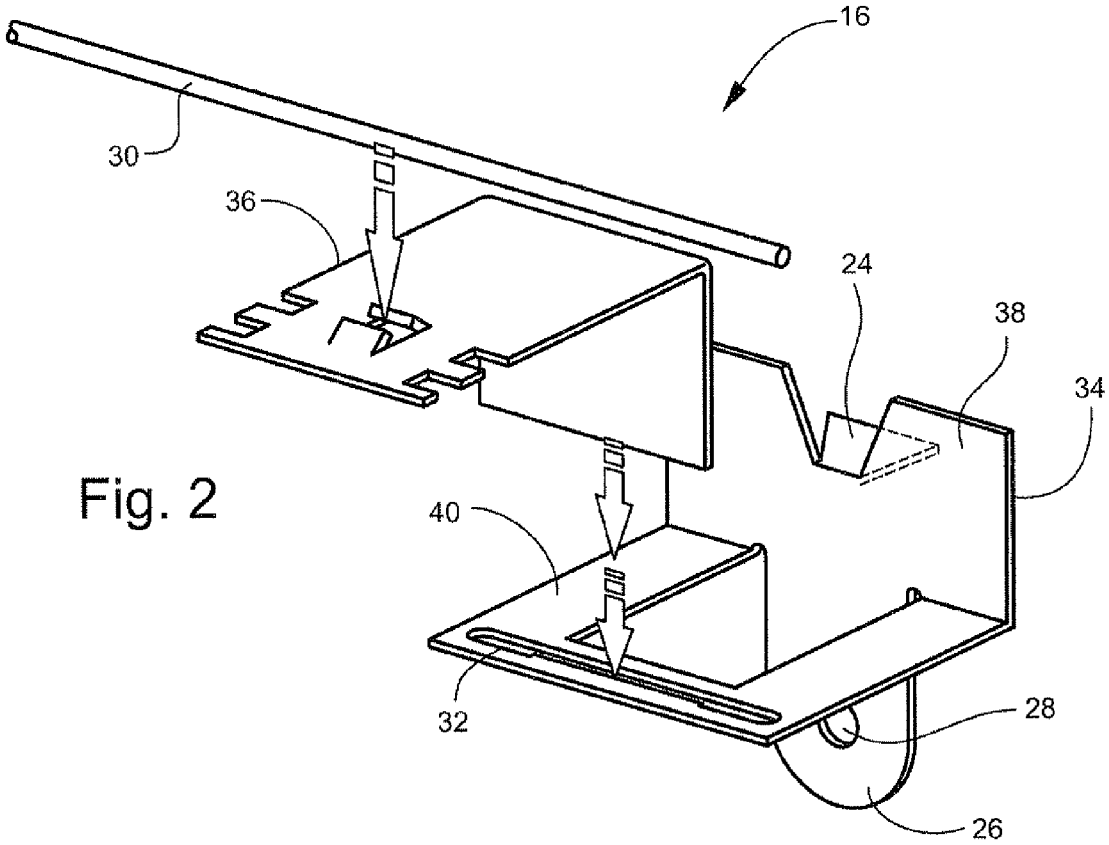
FIG. 2 is a perspective view of a masonry anchor showing its components detached.
Figure 3:
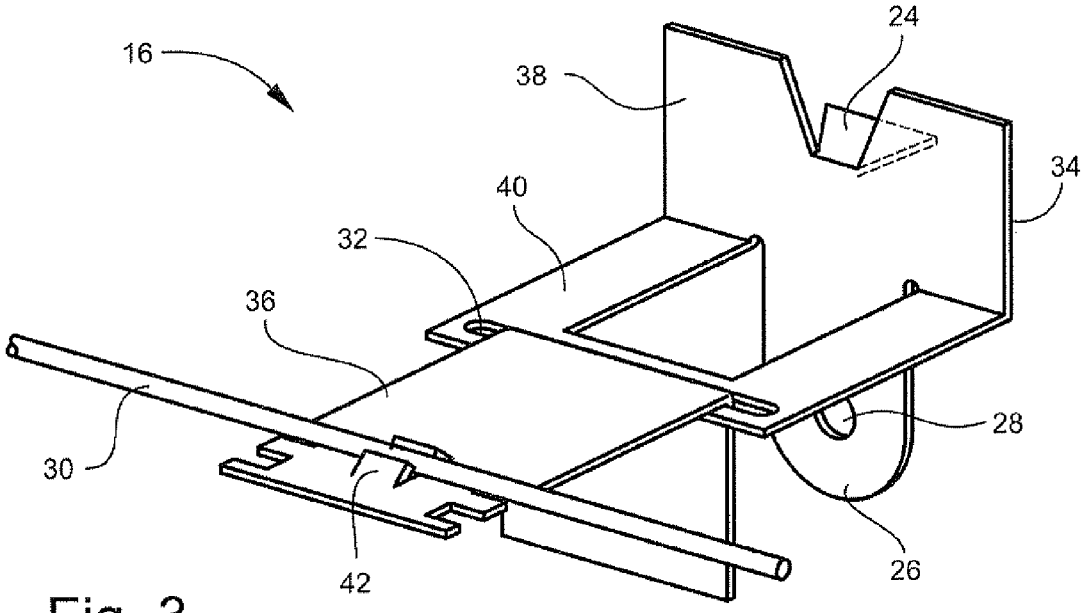
FIG. 3 is a perspective view of a masonry anchor showing its components attached.

Referring to FIGS. 2 and 3 respectively, detached and attached perspective views of one embodiment of a masonry anchor 16 are illustrated. Masonry anchor 16 generally includes a dovetail plate 34 adapted to attach to inner wall 12 and an anchor 36 adapted to attach to outer wall 14. Dovetail plate 34 generally includes plate 38 having first and second opposing major planar faces and a perimeter. Dovetail 24 extends from one major planar face in a direction generally perpendicularly thereto and leg 40 extends from the opposing major planar face in a direction generally perpendicular thereto. Dovetail plate 34 can be made from a planar blank by cutting dovetail 24 and bending it "downward" to the desired angle and cutting leg 40 and bending it "upward" to the desired angle. Dovetail 24 can have any desired shape for engaging a complimentary-shaped slot.

Leg 40 defines slot 32 thereto adjacent its free and arranged transverse to the extension direction of leg 40. Slot 32 is narrow and elongate and sized to receive a narrow elongate portion or legs of anchor 36 therethrough. When attached leg 40 and rod-carrying portion of anchor 36 are generally coplanar and plate 38 seats with one major planar face substantially flush against the exterior surface of inner wall 12.

Anchor 36 of masonry anchor 16 is generally a flat, elongate member bent to define a right angle. Adjacent its rod-carrying end, tabs 42 are cut in anchor 36, bent upward to an open position, and closed over rod 30 to cooperatively capture the rod. Anchor 36 further defines notches or other non-linear perimeter about its rod-capturing end that increase the mortar bonding area around the anchor 36.

Figure 4:
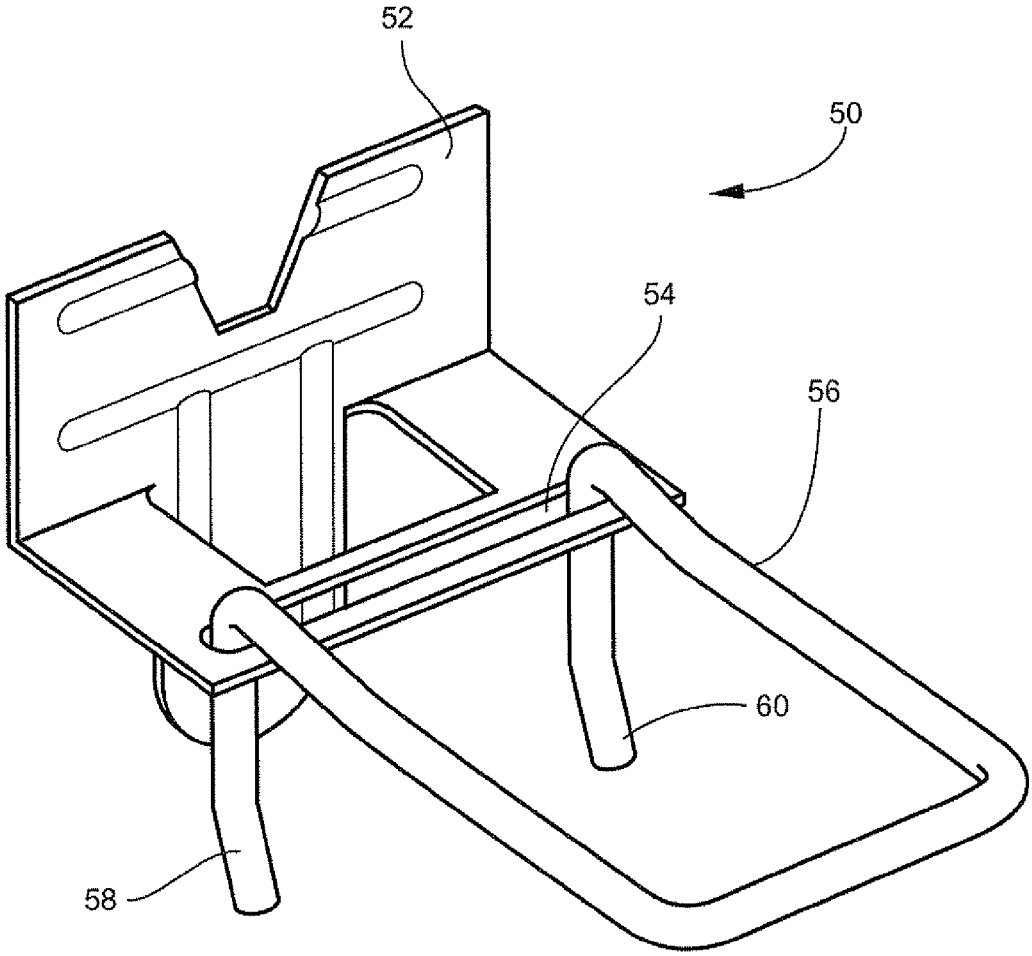
FIG. 4 is a perspective view of another embodiment of a masonry anchor including a dovetail plate and pintle.

Referring to FIG. 4, an alternative embodiment of a masonry anchor is shown generally at reference numeral 50. Masonry anchor 50 has a dovetail plate 52 substantially similar to dovetail plate 34. Dovetail plate 52 has a slotted leg defining slot 54 that corresponds to pintle 56. Pintle 56 can be a continuous length of rod having a circular cross-section bent to define first and second legs 58, 60 oriented in the same direction and at a right angle to the body of pintle 56. First and second legs 58, 60 are received through slot 54 to attach pintle 56 to dovetail plate 52. Legs 58, 60 have a length sufficient to permit some vertical movement of pintle 56 with respect to dovetail plate 52 without detachment of components. Although not shown, it is envisioned that pintle 56 may include structure for securing a continuos rod such as rod 30. Pintle 56 can have a width between legs 58 and 60 greater than a length of corresponding slot 54 such that insertion into slot 54 requires compression of legs 58 and 60.

Although specific embodiments of a masonry anchor and examples of use are disclosed above, it is envisioned that various embodiments of the invention can be made without departing from its scope. Furthermore, the foregoing description of the preferred embodiment of the invention and the best mode for practicing the invention are provided for the purpose of illustration only and not for the purpose of limitation, the invention being defined by the claims.

What is claimed is:

1. A masonry anchor, comprising: a vertical plate having an attachment feature comprising a dovetail extending horizontally from the vertical plate in a first direction and configured to engage within a vertically extending slot in a wall, and a leg extending horizontally from the vertical plate in a second direction opposite the first direction, the leg defining an elongate slot therethrough positioned adjacent a free end of the leg and oriented transverse to the second direction, the plate defining an opening therethrough for receiving a fastener, the leg extending horizontally from the vertical plate intermediate the opening and the attachment feature; and an anchor, the anchor being a right-angled member;

wherein the elongate slot has a length greater than a width of the anchor;

wherein the anchor is connected to the leg through the elongated slot such that the anchor is incapable of being separated from the leg by moving the anchor in a horizontal direction.

2. The masonry anchor according to claim 1, wherein the anchor is a flat, elongate right-angled member.

3. The masonry anchor according to claim 1, further comprising a rod captured by the anchor apart from an engagement point of the anchor and the leg.

4. The masonry anchor according to claim 3, wherein the anchor comprises tabs that cooperatively capture the rod.

5. The masonry anchor according to claim 1, wherein the anchor defines a notched perimeter for increasing bonding surface area of the anchor.

6. The masonry anchor according to claim 1, wherein the anchor is a rod bent to define first and second legs.

7. A masonry wall anchoring system, comprising: a plurality of masonry anchors, each of the plurality of masonry anchors comprising:

a vertical plate having an attachment feature comprising a dovetail extending horizontally from the vertical plate in a first direction and configured to engage within a vertically extending slot in a wall, and a leg extending horizontally from the vertical plate in a second direction opposite the first direction, the leg defining an elongate slot therethrough positioned adjacent a free end of the leg and oriented transverse to the second direction, the plate defining an opening therethrough for receiving a fastener, the leg extending horizontally from the plate intermediate the opening and the attachment feature; and an anchor, the anchor being a right-angled member;

wherein the elongate slot has a length greater than a width of the anchor;

wherein the anchor is connected to the leg through the elongated slot such that the anchor is incapable of being separated from the leg by moving the anchor in a horizontal direction;

the masonry wall anchor system further comprising an elongate rod captured by each of the anchors of the plurality of masonry anchors within a common row.

8. The wall anchoring system according to claim 7, wherein each of the anchors is a flat, elongate right-angled member.

9. The wall anchoring system according to claim 7, wherein each of the anchors defines a notched perimeter for increasing bonding surface area of each of the anchors.

10. A masonry wall anchoring system, comprising:

a first wall comprising vertically extending slots;

a second wall constructed of courses of block;

a plurality of masonry anchors connecting the first wall to the second wall, each of the plurality of masonry anchors comprising:

a vertical plate having an attachment feature comprising a dovetail extending horizontally from the vertical plate in a first direction being received in one of the vertically extending slots of the first wall, and a leg extending horizontally from the vertical plate in a second direction opposite the first direction, the leg defining an elongate slot therethrough positioned adjacent a free end of the leg and oriented transverse to the second direction, the plate defining an opening therethrough for receiving a fastener to attach the plate to the first wall, the leg extending horizontally from the vertical plate intermediate the opening and the attachment feature; and an anchor, the anchor being a right-angled member engaging within the elongate slot of the leg, wherein the elongate slot has a length greater than a width of the anchor, such that the anchor is incapable of being separated from the leg by moving the anchor in a horizontal direction; and the masonry wall anchoring system further comprising an elongate rod captured by each of the anchors of the plurality of masonry anchors in a common row.

11. The wall anchoring system according to claim 10, wherein each of the attachment features and each of the vertically extending slots of the first wall have complimentary shapes.

* * * * *